US010636409B2

(12) United States Patent
Yuzuriha et al.

(10) Patent No.: US 10,636,409 B2
(45) Date of Patent: Apr. 28, 2020

(54) SOUND COLLECTING APPARATUS, SOUND COLLECTION METHOD, RECORDING MEDIUM RECORDING PROGRAM, AND IMAGING APPARATUS

(71) Applicant: Panasonic Intellectual Property Corporation of America, Torrance, CA (US)

(72) Inventors: Shinichi Yuzuriha, Osaka (JP); Takeo Kanamori, Osaka (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 15/897,026

(22) Filed: Feb. 14, 2018

(65) Prior Publication Data

US 2018/0247635 A1 Aug. 30, 2018

(30) Foreign Application Priority Data

Feb. 28, 2017 (JP) ..... 2017-036817

(51) Int. Cl.
*G10K 11/178* (2006.01)
*G10L 25/51* (2013.01)
(Continued)

(52) U.S. Cl.
CPC ..... *G10K 11/17837* (2018.01); *G10L 25/51* (2013.01); *H04R 29/004* (2013.01);
(Continued)

(58) Field of Classification Search
None
See application file for complete search history.

(56) References Cited

U.S. PATENT DOCUMENTS

2008/0019246 A1* 1/2008 Sutardja ..... G11B 5/5526 369/47.38
2009/0175466 A1* 7/2009 Elko ..... H04R 3/005 381/94.2

(Continued)

FOREIGN PATENT DOCUMENTS

JP 2011-512732 4/2011
WO 2009/097407 8/2009

OTHER PUBLICATIONS

The Extended European Search Report from the European Patent Office (EPO) dated Mar. 23, 2018 for the related European Patent Application No. 18157568.9.

*Primary Examiner* — Antim G Shah
(74) *Attorney, Agent, or Firm* — Greenblum & Bernstein, P.L.C.

(57) ABSTRACT

A sound collecting apparatus is provided. The sound collecting apparatus includes a plurality of microphones that collects external sounds and sounds from noise sources in the sound collecting apparatus. Each microphone outputs a microphone signal. The microphone signal is divided, on a one-to-one basis for each microphone, into signals in mutually different frequency bands. A signal level is calculated, on a one-to-one basis for each divided microphone signal, for each of the mutually different frequency bands. Correlation values are calculated between the microphones for each group of identical frequency bands according to the signal level calculated for each of the mutually different frequency bands of each divided microphone signal. It is decided whether at least one of the microphones is sound-insulated, according to the correlation values.

18 Claims, 9 Drawing Sheets

(51) Int. Cl.

| | |
|---|---|
| ***H04R 29/00*** | (2006.01) |
| *G10L 21/0216* | (2013.01) |
| *H04R 3/00* | (2006.01) |
| *H04R 1/26* | (2006.01) |

(52) U.S. Cl.
CPC ..... *G10K 2210/30231* (2013.01); *G10L 2021/02166* (2013.01); *H04R 1/265* (2013.01); *H04R 3/005* (2013.01); *H04R 2430/03* (2013.01); *H04R 2499/11* (2013.01)

(56) References Cited

U.S. PATENT DOCUMENTS

| | | | | |
|---|---|---|---|---|
| 2011/0317848 | A1 | 12/2011 | Ivanov et al. | |
| 2014/0341547 | A1* | 11/2014 | Shenoy | H04N 5/91 386/285 |
| 2015/0304786 | A1 | 10/2015 | Partio et al. | |
| 2015/0334489 | A1 | 11/2015 | Iyengar et al. | |
| 2015/0356964 | A1* | 12/2015 | Ono | H04R 3/005 381/71.1 |
| 2016/0050488 | A1* | 2/2016 | Matheja | H04R 3/005 381/56 |
| 2017/0055072 | A1* | 2/2017 | Kim | H04N 1/2112 |
| 2017/0272878 | A1* | 9/2017 | Partio | H04R 3/04 |

* cited by examiner

SOUND COLLECTING APPARATUS, SOUND COLLECTION METHOD, RECORDING MEDIUM RECORDING PROGRAM, AND IMAGING APPARATUS

BACKGROUND

1. Technical Field

The present disclosure relates to a sound collecting apparatus, a sound collection method, a recording medium recording a program that executes the sound collection method, and an imaging apparatus that uses the sound collecting apparatus.

2. Description of the Related Art

Along with the widespread use of digital still cameras (DSCs), smartphones, and the like, moving pictures are frequently taken in recent years. In view of this situation, a plurality of sound collecting apparatuses have been mounted in a DSC, a smartphone, or another imaging apparatus. When a plurality of sound collecting apparatuses are mounted in an imaging apparatus, various types of signal processing become possible. When a moving picture is taken in a rainy weather, however, a sound hole formed in the imaging apparatus to collect sounds is covered with water droplets. The sound hole may be covered with the user's hand. If this sound hole is covered, surrounding sounds cannot be collected normally, causing a problem in that, for example, surrounding sounds are not clearly included easily due to a malfunction in signal processing. When a sound hole is covered and thereby surrounding holes are not collected easily, signal levels based on collected sounds are lowered. Therefore, this phenomenon has been used to detect a state in which a sound hole is covered.

For example, a mobile apparatus having a primary microphone and a secondary microphone is disclosed as an example of a sound collecting apparatus (see Japanese Patent 4981975). The mobile apparatus obtains the signal properties of the primary microphone and secondary microphones and decides, from the signal properties, whether the secondary microphone is sound-insulated.

SUMMARY

However, the conventional mobile apparatus just obtains the signal properties of the primary microphone and secondary microphones and decides, from these signal properties, whether the secondary microphone is sound-insulated. If both sound holes are covered, therefore, it is not possible to normally detect whether the sound holes are in a state in which they are covered.

There is another problem attributable to an image stabilization mechanism, a fan used as measures against heat generated in high-speed signal processing, or the like that is usually provided in the housing of a mobile apparatus. If a sound hole is covered, sounds from, for example, the image stabilization mechanism or heat fan may be collected. This may increase the noise level of a collected voice. Therefore, in an approach based on the fact that when a sound hole is covered, the level of a sound collected from the outside is lowered, it becomes not possible to normally detect a state in which a sound hole is covered.

One non-limiting and exemplary embodiment provides a sound collecting apparatus, a sound collection method, a recording medium recording a program, and an imaging apparatus that can all decide correctly whether the microphones are sound-insulated.

In one general aspect, the techniques disclosed here feature a sound collecting apparatus that includes: a plurality of microphones that collects a first sound from outside the sound collecting apparatus and a second sound from a noise source in the sound collecting apparatus, each of the plurality of microphones outputting a microphone signal; and at least one processor that, in operation, performs operations including: dividing, on a one-to-one basis with the plurality of microphones, the microphone signal output by each of the plurality of microphones into signals in mutually different frequency bands; calculating, on a one-to-one basis with the dividing of the microphone signal output by each of the plurality of microphones, a signal level for each of the mutually different frequency bands; calculating correlation values between the plurality of microphones for each group of identical frequency bands according to the signal level calculated for each of the mutually different frequency bands; and deciding whether at least one of the plurality of microphones is sound-insulated, according to the correlation values.

It should be noted that these general or specific aspects may be implemented as a system, a method, an integrated circuit, a computer program, a recording medium such as a computer-readable compact disc-read-only memory (CD-ROM), or any selective combination thereof.

According to this disclosure, it is possible to correctly decide whether at least one microphone is sound-insulated.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
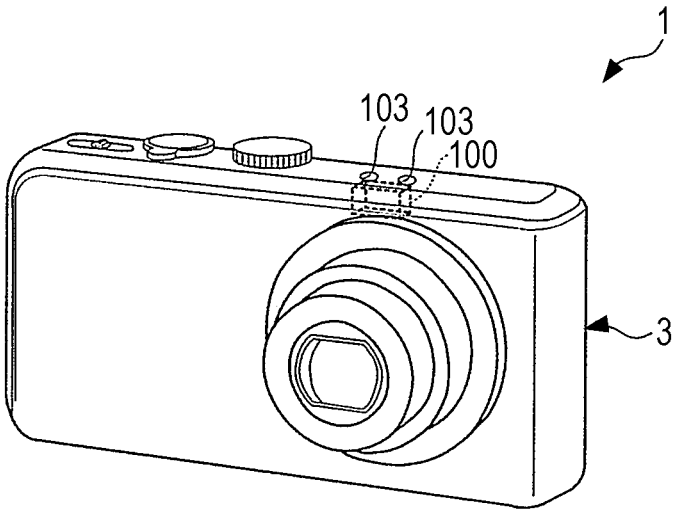
FIG. 1 schematically illustrates an imaging apparatus according to an embodiment.

A sound collecting apparatus according to an aspect of the present disclosure has: a plurality of microphones that collect sounds outside the sound collecting apparatus and sounds from noise sources in the sound collecting apparatus, each microphone outputting a microphone signal; a plurality of dividers corresponding to the plurality of microphones on a one-to-one basis, each divider dividing the microphone signal into signals in mutually different frequency bands; a plurality of signal level calculators corresponding to the plurality of dividers on a one-to-one basis, each signal level calculator calculating a signal level for each frequency band; a correlation calculator that calculates a correlation value between the plurality of microphones for each identical frequency band according to signal levels; and a decider that decides whether at least one of the plurality of microphones is sound-insulated, according to a plurality of correlation values.

According to this, the divider divides a microphone signal into signals in a plurality of frequency bands and the signal level calculators calculate a signal level for each frequency band. In an example in which two signal level calculators are provided, the correlation calculator calculates a correlation value between two microphones for each identical frequency band according to signal levels calculated by one correlation calculator and signal levels calculated by the other correlation calculator. Therefore, the decider can decide whether at last one microphone is sound-insulated in sound collection, according to correlation values.

Accordingly, it is possible to correctly decide whether at least one microphone is sound-insulated.

In the sound collecting apparatus according to an aspect of the present disclosure, if at least one of the plurality of correlation values exceeds a first threshold, the decider decides that the microphones are sound-insulated.

According to this, if at least one correlation value exceeds the first threshold, the decider decides that both microphones are sound-insulated. Therefore, it is possible to more accurately distinguish a difference between a case in which none of the microphones are sound-insulated and a case in which all of the microphones are sound-insulated.

In the sound collecting apparatus according to an aspect of the present disclosure, the divider divides a signal into signals in frequency bands of 1 kHz or lower and signals in frequency bands higher than 1 kHz. If the decider decides that correlation values only in frequency bands of 1 kHz or lower exceed the first threshold, the decider decides that the microphones are not sound-insulated.

According to this, the divider divides a signal with respect to a frequency of 1 kHz and, if the decider decides that the first threshold is exceeded only in frequency bands of 1 kHz or lower, the decider decides that the microphones are not sound-insulated. Therefore, even if there are sounds attributable to a wind, vibration, and the like, it is possible to more accurately determine whether the microphones are sound-insulated.

In the sound collecting apparatus according to an aspect of the present disclosure, the correlation calculator calculates variance values from a plurality of correlation values for each frequency band and, if the decider decides that at least one of the calculated variance values exceeds a second threshold, the decider decides that the microphones are sound-insulated.

According to this, since the correlation calculator calculates variance values from a plurality of correlation values for each frequency band and, if at least one of the calculated variance values exceeds the second threshold, it is decided that the microphones are sound-insulated, it is possible to more accurately determine whether the microphones are sound-insulated.

A sound collection method according to an aspect of the present disclosure, the method being for a sound collecting apparatus having a plurality of microphones, includes: collecting sounds outside the sound collecting apparatus and sounds from noise sources in the sound collecting apparatus by the use of the plurality of microphones, and outputting a plurality of microphone signals; dividing each of the plurality of microphone signals into signals in mutually different frequency bands; calculating a signal level for each frequency band; calculating a correlation value between the plurality of microphones for each identical frequency band according to signal levels; and deciding whether at least one of the plurality of microphones is sound-insulated, according to a plurality of correlation values.

In this sound collection method as well, effects similar to the effects of the sound collecting apparatus are obtained.

In a computer-readable non-transitory recording medium, according to an aspect of the present disclosure, that records a program that causes a computer to execute a sound collection method for a sound collecting apparatus having a plurality of microphones, when the program is executed in the computer, the program causes the computer to execute a method including: collecting sounds outside the sound collecting apparatus and sounds from noise sources in the sound collecting apparatus by the use of the plurality of microphones, and outputting a plurality of microphone signals; dividing each of the plurality of microphone signals into signals in mutually different frequency bands; calculating a signal level for each frequency band; calculating a correlation value between the plurality of microphones for each identical frequency band according to signal levels; and deciding whether at least one of the plurality of microphones is sound-insulated, according to a plurality of correlation values.

With the recording medium as well that records the program that can cause a computer to execute the sound collection method, effects similar to the effects of the sound collecting apparatus are obtained.

An imaging apparatus according to an aspect of the present disclosure has a sound collecting apparatus, a displayer, and a controller. The sound collecting apparatus has a plurality of microphones that collect sounds outside the sound collecting apparatus and sounds from noise sources in the sound collecting apparatus, each microphone outputting a microphone signal; a plurality of dividers corresponding to the plurality of microphones on a one-to-one basis, each divider dividing the microphone signal into signals in mutually different frequency bands; a plurality of signal level calculators corresponding to the plurality of dividers on a one-to-one basis, each signal level calculator calculating a signal level for each frequency band; a correlation calculator that calculates a correlation value between the plurality of microphones for each identical frequency band according to signal levels; and a decider that decides whether at least one of the plurality of microphones is sound-insulated, according to a plurality of correlation values. The controller receives, from the decider, information indicating that at least one microphone is sound-insulated and causes the displayer to display information indicating the sound insulation.

According to this, since the controller receives, from the decider, information indicating that at least one microphone is sound-insulated and causes the displayer to display information indicating the sound insulation, the user can recognize that at least one microphone is sound-insulated.

Embodiments described below are just specific examples of the present disclosure. Numerals, shapes, constituent elements, steps, the sequence of these steps, and the like indicated in the embodiment below are just examples, and are not intended to restrict the present disclosure. Of the constituent elements in the embodiment below, constituent elements not described in independent claims, each of which indicates the topmost concept of the present disclosure, will be described as arbitrary constituent elements. Contents in all embodiments may be combined.

Each drawing is a schematic drawing and is not necessarily drawn in a rigorous manner. In all drawings, the essentially same constituent elements are denoted by the same numerals and repeated descriptions will be omitted or simplified.

Embodiment

A sound collecting apparatus 100 and an imaging apparatus 1 according to an embodiment of the present disclosure will be described below.

Structure

Figure 2:
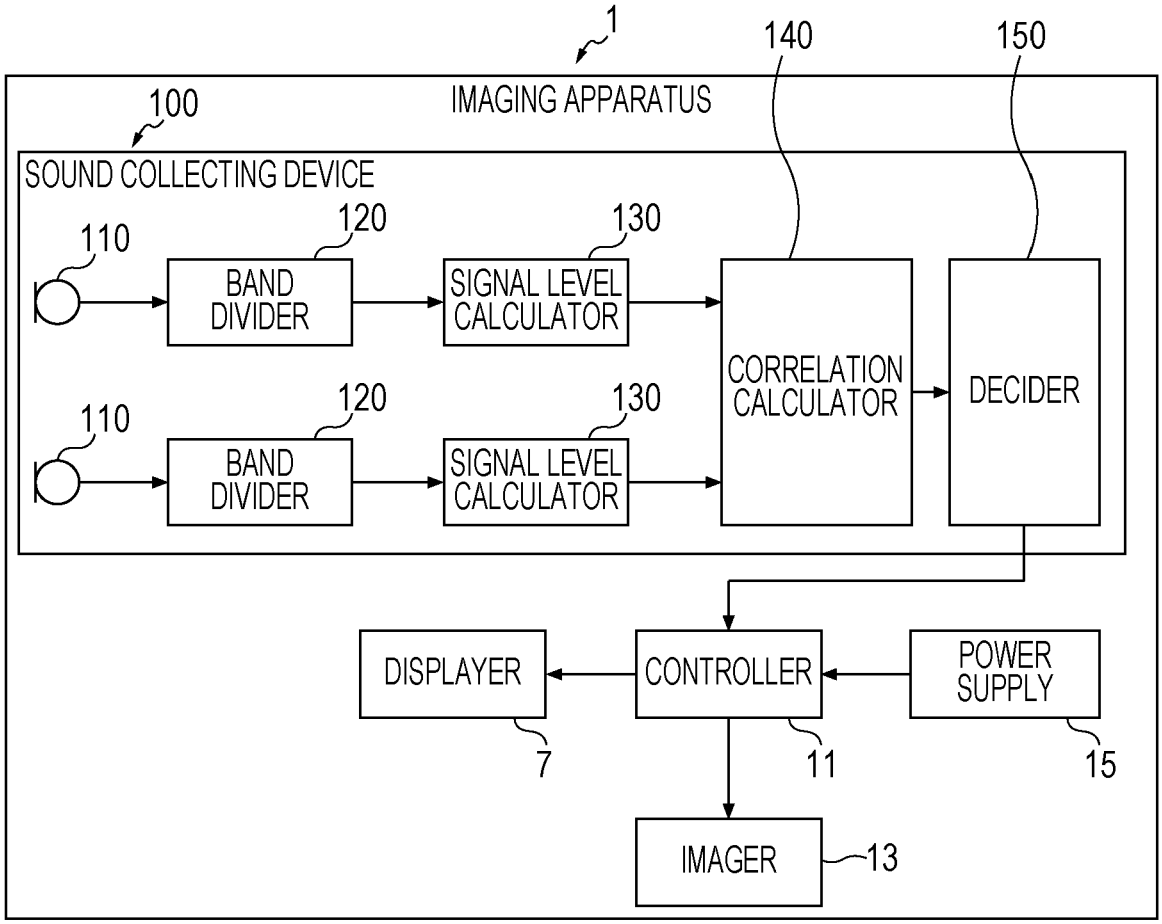
FIG. 2 is a block diagram indicating the imaging apparatus according to the embodiment.

FIG. 1 schematically illustrates the imaging apparatus 1 according to the embodiment. FIG. 2 is a block diagram indicating the imaging apparatus 1 according to the embodiment.

As illustrated in FIG. 1, the imaging apparatus 1 is, for example, a DSC, a smartphone, or another apparatus that not only can take a moving picture but also can collect voices. In the embodiment, a DSC is used as an example of the imaging apparatus 1.

As illustrated in FIGS. 1 and 2, the imaging apparatus 1 has the sound collecting apparatus 100, a main body 3, and an imager 13.

With the sound collecting apparatus 100, a plurality of microphones 110 collect external sounds and sounds from noise sources in the sound collecting apparatus 100, after which each microphone 110 outputs a microphone signal. The sound collecting apparatus 100 is accommodated in the main body 3. Sound holes 103 through which sounds are transmitted to the microphones 110 in the sound collecting apparatus 100 are formed in the housing of the main body 3. The sound collecting apparatus 100 has the plurality of microphones 110, a plurality of band dividers 120 (an example of dividers), a plurality of signal level calculators 130, a correlation calculator 140, and a decider 150. The sound collecting apparatus 100 in this embodiment uses two microphones 110, two band dividers 120, and two signal level calculator 130.

Each microphone 110 is a device that collects a sound outside the imaging apparatus 1 and a sound from a noise source through the relevant sound hole 103 formed in the housing of the main body 3, and outputs a microphone signal based on the collected sound. The noise source is a sound source attributable to an image stabilization mechanism, a heat fan, or the like accommodated in the imaging apparatus 1.

The band divider 120 is electrically connected to the microphone 110. The microphone signal output by the 110 is input to the band divider 120. In this embodiment, the microphone 110 is placed on, for example, the upper end face of the main body 3. However, there is no particular limitation on the placement of the microphone 110.

The plurality of band dividers 120 correspond to the plurality of microphones 110 on a one-to-one basis. Each band divider 120 is a device that divides a microphone signal into signals in mutually different frequency bands. The passbands of the plurality of band dividers 120 are mutually different. Each band divider 120 has a set of a plurality of band dividing filters. The set of a plurality of band dividing filters is, for example, a set of a plurality of band-pass filters or a set of a plurality of low-pass filters and a plurality of high-pass filters. A microphone signal input from the microphone 110 to the band divider 120 is input to each of the plurality of band-pass filters.

The passbands of the plurality of band-pass filters are mutually different. In an example, a first band-pass filter uses a high-frequency region in a frequency band as a first frequency band, a second band-pass filter uses an intermediate region, which does not overlap the passband of the first band-pass filter, in the frequency band as a second frequency band, and a third band-pass filter uses a low-frequency region, which does not overlap the passbands of the first band-pass filter and second band-pass filter, in the frequency band as a third frequency band. In this case, for example, the first band-pass filter outputs only microphone signals in the first frequency band, the second band-pass filter outputs only microphone signals in the second frequency band, and the third band-pass filter outputs only microphone signals in the third frequency band. That is, the plurality of band-pass filters fulfill the role of a band-dividing filter that divides the band of the output signal from the microphone 110. Here, three band-pass filters have been used to simplify the descriptions. In this embodiment, however, the band divider 120 has eight band-pass filters to divide a microphone signal into signals in eight frequency bands in which their passbands do not overlap. In this embodiment, however, there are no particular limitations on the number of divisions of a frequency band, divided frequency bands, and the like.

In this embodiment, there is a match between frequency bands into which one band divider 120 divides a microphone signal and frequency bands into which the other band divider 120 divides a microphone signal.

The signal level calculator 130 is electrically connected to the band divider 120. The band divider 120 outputs a microphone signal in each divided frequency band to the signal level calculator 130.

Two reasons why the band divider 120 is used to divide a microphone signal into signals in a plurality of frequency bands will be described below.

A first reason is that, for example, even if one sound hole 103 in the sound collecting apparatus 100 is covered, the behavior of a signal level corresponding to the microphone 110 may change because, for example, a little clearance may be formed in the sound hole 103. This is because the frequency property differs depending on how the sound hole 103 is covered. In addition, if there is a noise source in the sound collecting apparatus 100, when the sound hole 103 is covered, much sound from the noise source is collected, increasing the signal level of the noise. Therefore, when the signal levels of signals in all frequency bands are just monitored, even if the sound hole 103 is covered, a difference may not appear in signal levels. In view of this, a microphone signal is divided into signals in different frequency bands so that changes in frequency property can be analyzed according to the results in FIGS. 7 and 9, which will be referenced later.

The state in which the sound hole 103 is covered refers to a state in which the microphone 110 is sound-insulated through the sound hole 103. However, this state refers to not only a state in which sounds that would otherwise enter the sound collecting apparatus 100 through the sound hole 103 are completely insulated but also a state in which external sounds slightly enter the sound collecting apparatus 100. This is also true for sound insulation; sound insulation refers to not only a state in which sounds that would otherwise enter the sound collecting apparatus 100 through the sound hole 103 are completely blocked but also a state in which external sounds slightly enter the sound collecting apparatus 100.

A second reason is to adapt to a case in which, in a state in which the sound hole 103 is not covered, a wind hits the sound hole 103 in the imaging apparatus 1 or some kind of vibration occurs, for example. Specifically, a sound attributable to a wind, vibration, or the like is generated when it directly swings the vibration plate of the microphone 110 and is thereby converted to a sound. Therefore, it is not possible to decide whether the sound is attributable to the fact that the sound holes 103 for the two microphones 110 have been covered. It is known that the signal levels of sounds of this type caused by a wind, vibration, or the like are mainly in frequency bands of 1 kHz or lower. Therefore, it is preferable to divide a microphone signal into signals in frequency bands of at least 1 kHz.

In view of this point, in this embodiment, the band divider 120 divides a microphone signal into signals in frequency bands of 1 kHz or lower and signals in frequency bands exceeding 1 kHz.

The plurality of signal level calculators 130 correspond to the plurality of band dividers 120 on a one-to-one basis. Each signal level calculator 130 is a device that calculates a signal level for each frequency band. The signal level calculator 130 calculates the signal level A(i) of a time signal according to equation (1), assuming that an observation signal in each frequency band is x(i, t) (i is a band number and t is a time sample) and that L is the number of samples to calculate an average.

$$A(i) = \frac{1}{L}\sum_{t=0}^{L-1} |x(i, t)| \tag{1}$$

Observation signal x(1, t) in each frequency band may be obtained from the mean-square value of observation signals instead of an absolute value. In calculation of an average, a method of calculating an exponential moving average or another type of average may be used instead of a method of calculating a moving average. Calculation of an average is not limited to a method in which equation (1) is used.

The correlation calculator 140 is electrically connected to the signal level calculators 130. Each signal level calculator 130 outputs the signal level, calculated according to equation (1), of each signal to the correlation calculator 140.

The two microphones 110 have the same structure. The two band dividers 120 have the same structure. The two signal level calculators 130 have the same structure. Therefore, the structures of the other microphone 110, the other band divider 120, and the other signal level calculator 130 will not be described. Three or more microphones 110, three or more band dividers 120, and three or more signal level calculator 130 may be provided.

The correlation calculator 140 calculates a correlation value between a plurality of microphones 110 for each identical frequency band according to signal levels. In an example of an embodiment, according to signal levels calculated by one signal level calculator 130 and signal levels calculated by the other signal level calculator 130, the correlation calculator 140 calculates a correlation value between two microphones 110 for each identical frequency band.

Specifically, the correlation calculator 140 calculates a ratio (an example of a correlation value) of signal levels in frequency bands according to the signal levels of the microphones 110. Assuming that, of the two microphones 110 in this embodiment, the signal level of one microphone 110 is A1(*i*) and the signal level of the other microphone 110 is A2(*i*), a correlation value R(i) is exponentially calculated according to equation (2).

$$R(i) = \frac{A_1(i)}{A_2(i)} \tag{2}$$

The decider 150 is electrically connected to the correlation calculator 140. The correlation calculator 140 outputs, to the decider 150, a correlation value matching the frequency band calculated according to equation (2). A first threshold is set so that a ratio of signal levels with the sound holes 103 covered and a ratio of signal levels with the sound holes 103 are not covered are distinguished from each other according to these ratios.

The decider 150 decides whether at least one of a plurality of microphones 110 is sound-insulated according to a plurality of correlation values. Specifically, if at least one of correlation values in different frequency bands exceeds the first threshold, the decider 150 decides that the microphones 110 are sound-insulated. That is, the decider 150 decides that the sound holes 103 in the housing of the imaging apparatus 1 are covered. By contrast, if all correlation values in different frequency bands are equal to or below the first threshold, the decider 150 decides that the microphones 110 are not sound-insulated. In this case, an alert does not need to be displayed on a displayer 7, which will be described later. The first threshold is set according to the results in FIGS. 7 and 9, which will be referenced later.

If the decider 150 decides that a correlation value exceeds the first threshold only in frequency bands of 1 kHz or lower, the decider 150 decides that the microphones 110 are not sound-insulated. This prevents the wrong decision that the sound holes 103 are covered.

In frequency bands of 1 kHz or higher, however, the microphones 110 are not easily affected by a wind, vibration, or the like, so the decider 150 outputs, to a controller 11, decision results including correlation values in frequency bands of 1 kHz or higher.

Besides the sound collecting apparatus 100, the main body 3 accommodates the displayer 7, the controller 11, a power supply 15, the imager 13, and the like. The main body 3 is shaped like a flat rectangular parallelepiped.

The displayer 7 is a monitor such as a liquid crystal display, a light-emitting-diode (LED) display, or an organic electroluminescent (EL) display. The displayer 7 is disposed on the rear surface of the main body 3. The displayer 7 displays a decision according to decision results made by the decider 150.

The controller 11 outputs, to the displayer 7, a decision result made by the decider 150 in the sound collecting apparatus 100. That is, the controller 11 receives, from the decider 150, information indicating that the microphones 110 are sound-insulated, and causes the displayer 7 to display information indicating that sound insulation is in progress. Specifically, if the decider 150 decides that the microphones 110 are sound-insulated, the controller 11 causes the displayer 7 to display an alert indicating that the microphones 110 are sound-insulated. The controller 11 may output, from a notifier such as a speaker, an alert indicating that the microphones 110 are sound-insulated. Through the displayer 7 or the notifier, the user recognizes that the microphones 110 are sound-insulated.

The power supply 15 is preferably a primary battery, but may be a secondary battery that receive electric power from a personal computer or another external power supply. Alternatively, the power supply 15 may externally receive grid-connected power. The power supply 15, which is connected to the controller 11, supplies electric power to the displayer 7, notifier, and the like through the controller 11.

Operations

The operations of the sound collecting apparatus 100 and imaging apparatus 1 in this embodiment, a sound collection method, and a recording medium recording a program that causes a computer to execute the sound collection method will be described with reference to FIG. 3.

Figure 3:
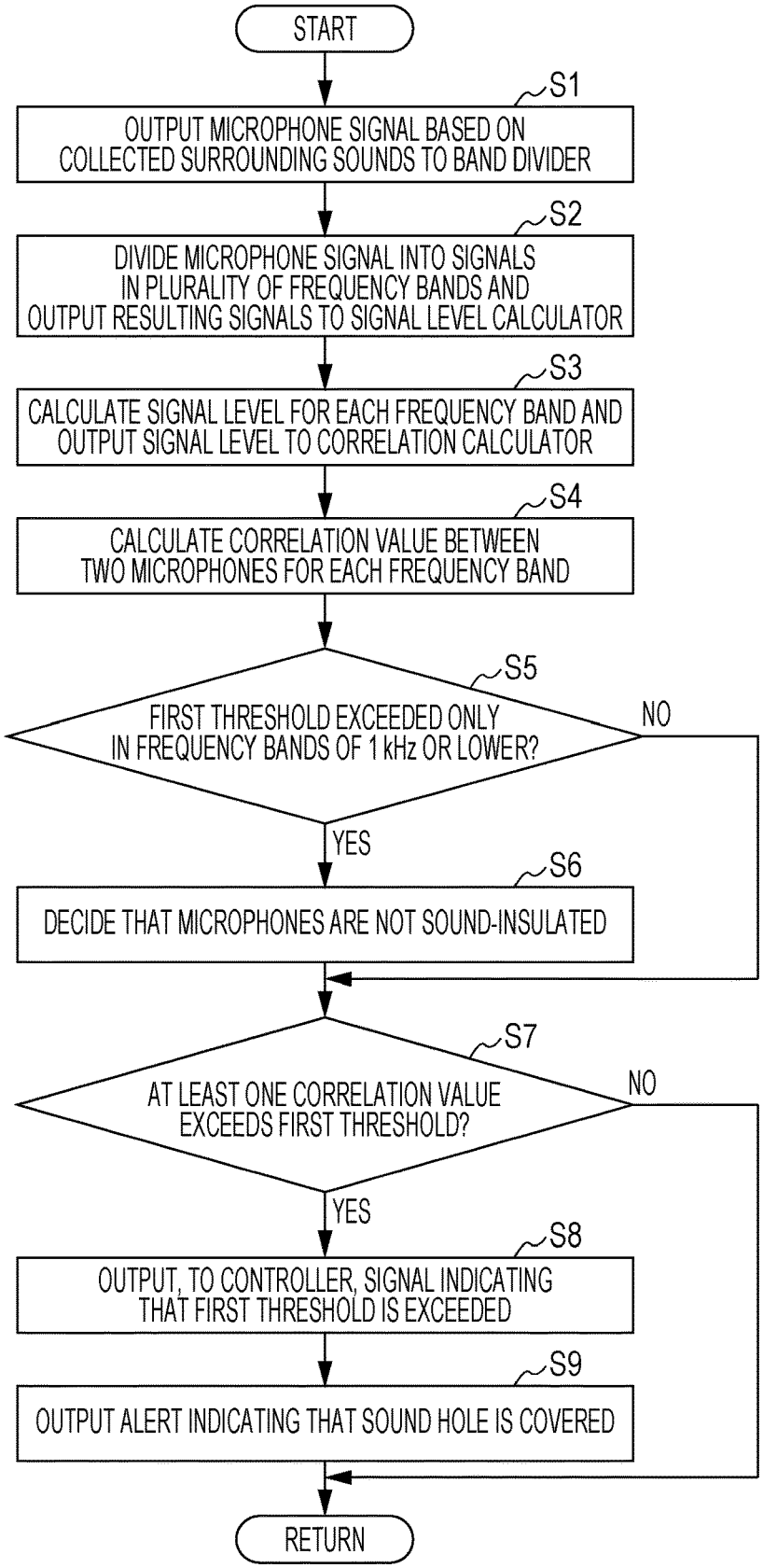
FIG. 3 is a flowchart indicating the operation of the imaging apparatus according to the embodiment.

FIG. 3 is a flowchart indicating the operation of the imaging apparatus 1 according to the embodiment.

First, the microphone 110 collects an external sound, a sound from a noise source, or the like and outputs a microphone signal to the band divider 120 (S1).

Next, the band divider 120 divides the microphone signal received from the microphone 110 into signals in a plurality of frequency bands. The band divider 120 then outputs the plurality of microphone signals obtained by the division into different frequency bands to the signal level calculator 130 (S2).

Next, the signal level calculator 130 calculates a signal level for each frequency band from the microphone signals obtained by the division into different frequency bands. The signal level calculator 130 then outputs each calculated signal level to the correlation calculator 140 (S3).

In steps S1 to S3, the operations of one microphone 110, one band divider 120, and one signal level calculator 130 have been described. The operations are also true for the other microphone 110, the other band divider 120, and the other signal level calculator 130, so their operations will be not be described. A plurality of signal levels obtained through one microphone 110 and the like and signal levels obtained through the other microphone 110 and the like are input to the correlation calculator 140.

Next, the correlation calculator 140 calculates a correlation value between the two microphones 110 for each identical frequency band, according to the plurality of signal levels calculated by one signal level calculator 130 and the plurality of signal levels calculated by the other signal level calculator 130. Specifically, the correlation calculator 140 calculates a correlation value between a first signal level, calculated by one signal level calculator 130, that corresponds to the first frequency band and a first signal level, calculated by the other signal level calculator 130, that corresponds to the first frequency band, according to equation (2). The correlation calculator 140 similarly calculates correlation values at other signal levels corresponding to other frequency bands. The correlation calculator 140 then outputs the calculated correlation values to the decider 150 (S4).

Next, the decider 150 decides whether correlation values exceed the first threshold only in frequency bands of 1 kHz or lower (S5).

Next, if the decider 150 decides that correlation value exceed the first threshold only in frequency bands of 1 kHz or lower (the result in S5 is Yes), the decider 150 decides that the microphones 110 are not sound-insulated (S6). To prevent the wrong decision that the sound holes 103 are covered when correlation values exceed the first threshold only in frequency bands of 1 kHz or lower, the decider 150 determines that there is a wind, vibration, or the like and decides that the microphones 110 are not sound-insulated.

If the decider 150 decides that correlation values are equal to or below the first threshold in frequency bands of 1 kHz or lower (the result in S5 is No), the flow proceeds to step S7.

Next, the decider 150 decides whether at least one of the correlation values, each of which is calculated for one frequency band, exceeds the first threshold (S7).

If the decider 150 decides that at least one correlation value in a certain frequency band exceeds the first threshold (the result in S7 is Yes), the decider 150 outputs, to the controller 11, a signal indicating that the first threshold is exceeded (S8). That is, even if the decider 150 decides that the microphones 110 are not sound-insulated, if the result in step S6 is decided to be Yes from results in frequency bands higher than 1 kHz, the decider 150 ignores effects by a wind, vibration, and the like and decides that the sound holes 103 are covered.

Next, the controller 11 receives, from the decider 150, a signal indicating that the first threshold is exceeded, after which the controller 11 outputs an alert indicating that the sound holes 103 are covered through the displayer 7 or the like (S9). After that, this flow returns to step S1.

If the decider 150 decides that at least one frequency band-specific correlation value is equal to or below the first threshold (the result in S7 is No), this flow returns to step S1.

Experimental Results

Experimental results obtained by the use of the sound collecting apparatus 100 in the imaging apparatus 1 will be described below.

Experiments were carried out in a state in which the sound holes 103 in the housing of the imaging apparatus 1 were not covered, in a state in which one sound hole 103 was covered, and both of the sound holes 103 were covered for both a case in which there was a noise source in the sound collecting apparatus 100 and a case in which there was no noise source in the sound collecting apparatus 100. In these experiments, microphones A and B similar to the microphones 110 in this embodiment were used. A sound source was placed at a distance of about 50 cm from the microphones A and B.

Figure 4:
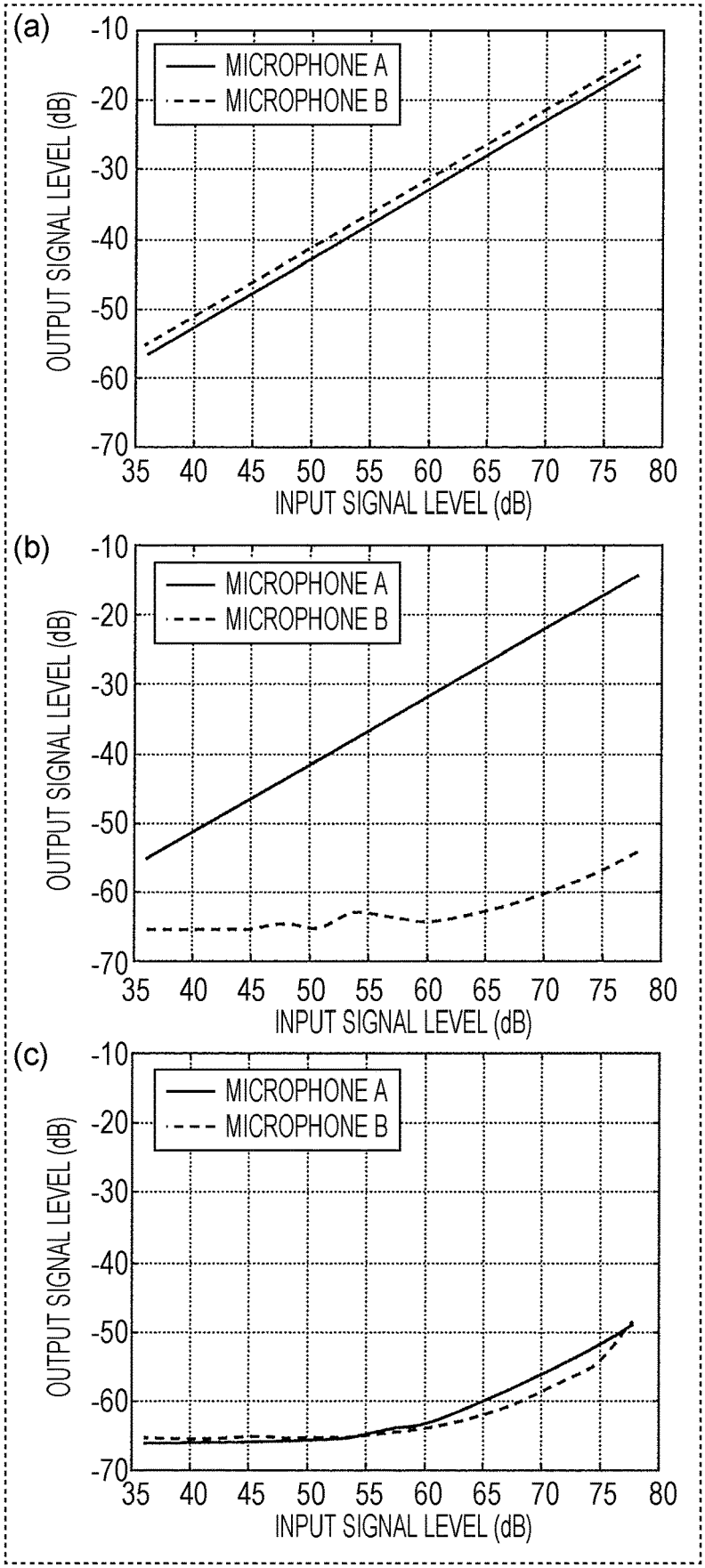
FIG. 4 illustrates graphs each of which indicates relationships between input signal level and output signal level in a case in which there was no noise source in a sound collecting apparatus.
Figure 5:
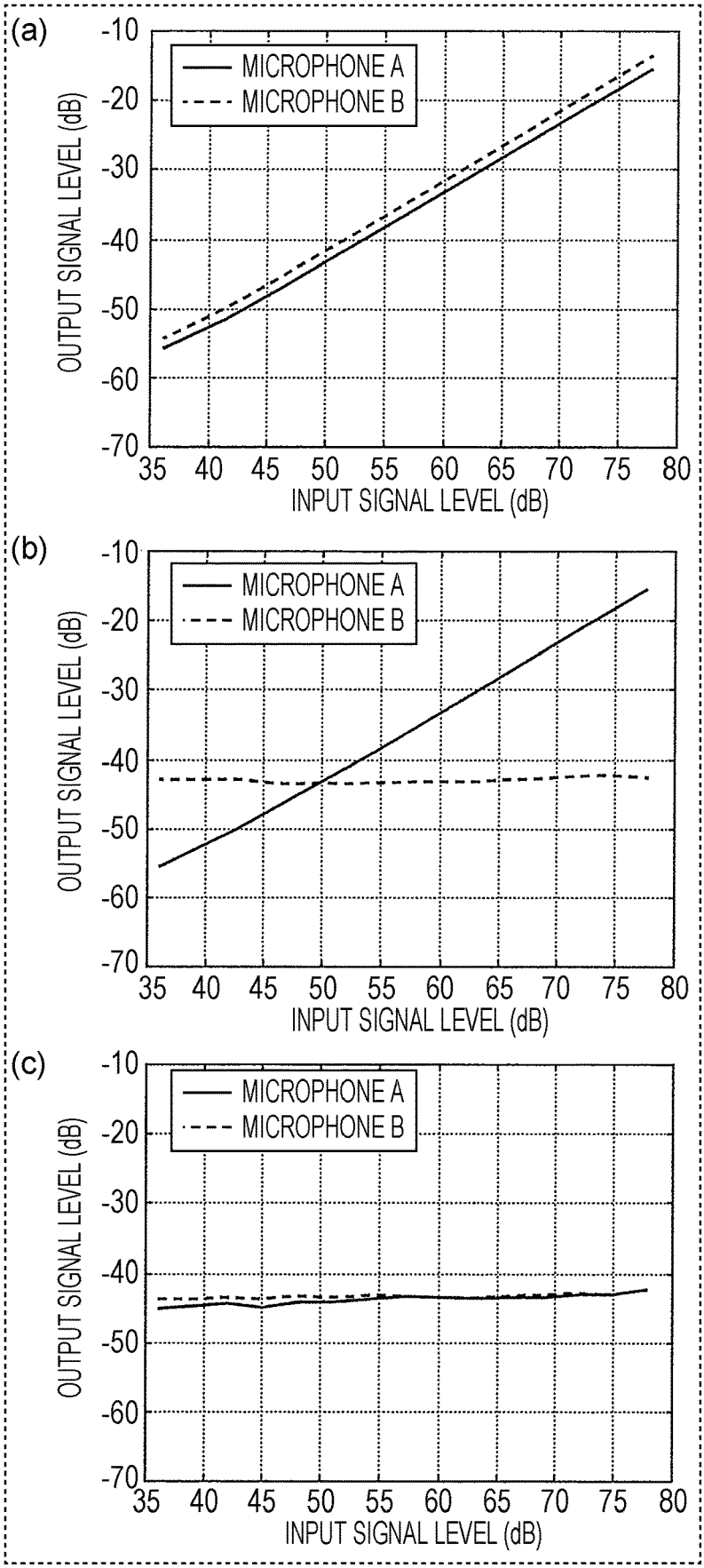
FIG. 5 illustrates graphs each of which indicates relationships between input signal level and output signal level in a case in which there was a noise source in the sound collecting apparatus.

FIG. 4 illustrates graphs each of which indicates relationships between input signal level and output signal level in a case in which there was no noise source in the sound collecting apparatus 100. FIG. 5 illustrates graphs each of which indicates relationships between input signal level and output signal level in a case in which there was a noise source in the sound collecting apparatus 100.

The graph in FIG. 4(*a*) indicates relationships between input signal level and output signal level in a case in which there was no noise source in the sound collecting apparatus 100 and in a state in which the sound holes 103 were not covered. As indicated in FIG. 4(*a*), when the sound holes 103 in the housing of the imaging apparatus 1 were not covered, sound waves were directly transmitted to the vibration plates of the microphones A and B. In the microphones A and B, therefore, output signal levels linear with respect to input signal levels were obtained.

The graph in FIG. 4(*b*) indicates relationships between input signal level and output signal level in a case in which there was no noise source in the sound collecting apparatus 100 and in a state in which one sound hole 103 was covered. In this experiment, the sound hole 103 corresponding to the microphone B was covered. In the microphone A, sound waves were directly transmitted to the vibration plate, so output signal levels linear with respect to input signal levels were obtained. In the microphone B, however, sound waves did not easily reach the vibration plate because the sound hole 103 was covered, so output signal levels were largely reduced with respect to input signal levels.

The graph in FIG. 4(*c*) indicates relationships between input signal level and output signal level in a case in which there was no noise source in the sound collecting apparatus 100 and in a state in which both of the sound holes 103 were covered. In FIG. 4(*c*), the sound holes 103 corresponding to the microphones A and B were covered, so sound waves did not easily reach the vibration plates and output signal levels were thereby largely reduced with respect to input signal levels.

In the graphs FIG. 4(*a*) and FIG. 4(*c*), there is a difference between the microphones A and B. However, the difference can be considered to be attributable to variations between these microphones.

The graph in FIG. 5(*a*) indicates relationships between input signal level and output signal level in a case in which there was a noise source in the sound collecting apparatus 100 and in a state in which the sound holes 103 were not covered. In FIG. 5(*a*) as well, results similar to results in FIG. 4(*a*) were obtained.

When there is a noise source in the sound collecting apparatus 100, a sound from the noise source may surround the microphones A and B and may be collected by them as a sound wave. Alternatively, the noise may be transmitted through the housing of the sound collecting apparatus 100 and the like as vibration and may be collected by the microphones A and B. Even if there is a noise source in the sound collecting apparatus 100, the signal level of noise itself is smaller than the signal levels of surrounding sounds. Therefore, when the sound holes 103 are not covered, there is no significant influence. Accordingly, when the sound holes 103 are not covered, the influence by the noise source in the sound collecting apparatus 100 is small and surrounding sound waves are transmitted directly to the vibration plates of the microphones A and B, so it can be thought that an output property linear with respect to the input signal level is obtained.

The graph in FIG. 5(*b*) indicates relationships between input signal level and output signal level in a case in which there was a noise source in the sound collecting apparatus 100 and in a state in which one of the sound holes 103 was covered. In this experiment, the sound hole 103 corresponding to the microphone B was covered. In FIG. 5(*b*), it is found that the output signal level for the microphone B is larger than in FIG. 4(*b*).

The main reason for this may be that, unlike FIG. 5(*a*), even if one sound hole 103 is covered, the influence by the noise source in the sound collecting apparatus 100 becomes unignorable and noise is transmitted through the housing of the sound collecting apparatus 100 and the like as vibration. If one sound hole 103 is covered, air pressed against a side surface, in the vicinity of the sound hole 103, of the housing due to vibration of the housing of the sound collecting apparatus 100 and the like cannot exit from the sound hole 103. The air vibrates the vibration plate. If there is a noise source in the sound collecting apparatus 100, therefore, even if there is no sound outside the sound collecting apparatus 100, it can be thought that the output signal level is increased. From the one sound hole 103 that has been covered, surrounding sounds are not transmitted directly to the vibration plate of the microphone B. When one sound hole 103 is covered, therefore, it can be thought that sounds attributable to the noise source in the sound collecting apparatus 100 become dominant and the output level becomes constant.

The graph in FIG. 5(*c*) indicates relationships between input signal level and output signal level in a case in which there was a noise source in the sound collecting apparatus 100 and in a state in which both of the sound holes 103 were covered.

When both of the sound holes 103 were covered, sounds attributable to the noise source in the sound collecting apparatus 100 became dominant, so the output signal levels of the microphones A and B became similar. The output signal levels of the microphones A and B also became similar to the output signal level of the microphone B in (b) in FIG. 5.

The experimental results in FIGS. 4 and 5 indicate that changes in the signal levels of the microphones A and B largely vary depending on whether there is a noise source in the sound collecting apparatus 100. Even if one sound hole 103 is covered, surrounding sounds cannot be collected. Therefore, if attention is focused only on the reduction in signal level as in the conventional art, a correct decision cannot be made.

With the sound collecting apparatus 100, therefore, a correlation value between a plurality of microphones 110 is calculated for each frequency band. If a correlation value exceeds the first threshold, it is decided whether at least one of the plurality of microphones 110 is sound-insulated. Therefore, whether at least one microphone 110 is sound-insulated can be correctly decided.

In view of this, the signal level output by the signal level calculator 130 will be described with reference to FIGS. 6 to 9 for a case in which voice was magnified so that its intensity became about 40 dB SPL and about 65 dB SPL in the vicinity of the microphone, in consideration that the output signal level when there was a noise source in the sound collecting apparatus 100 became larger than the output signal level when there was no noise source in the sound collecting apparatus 100.

Figure 6:
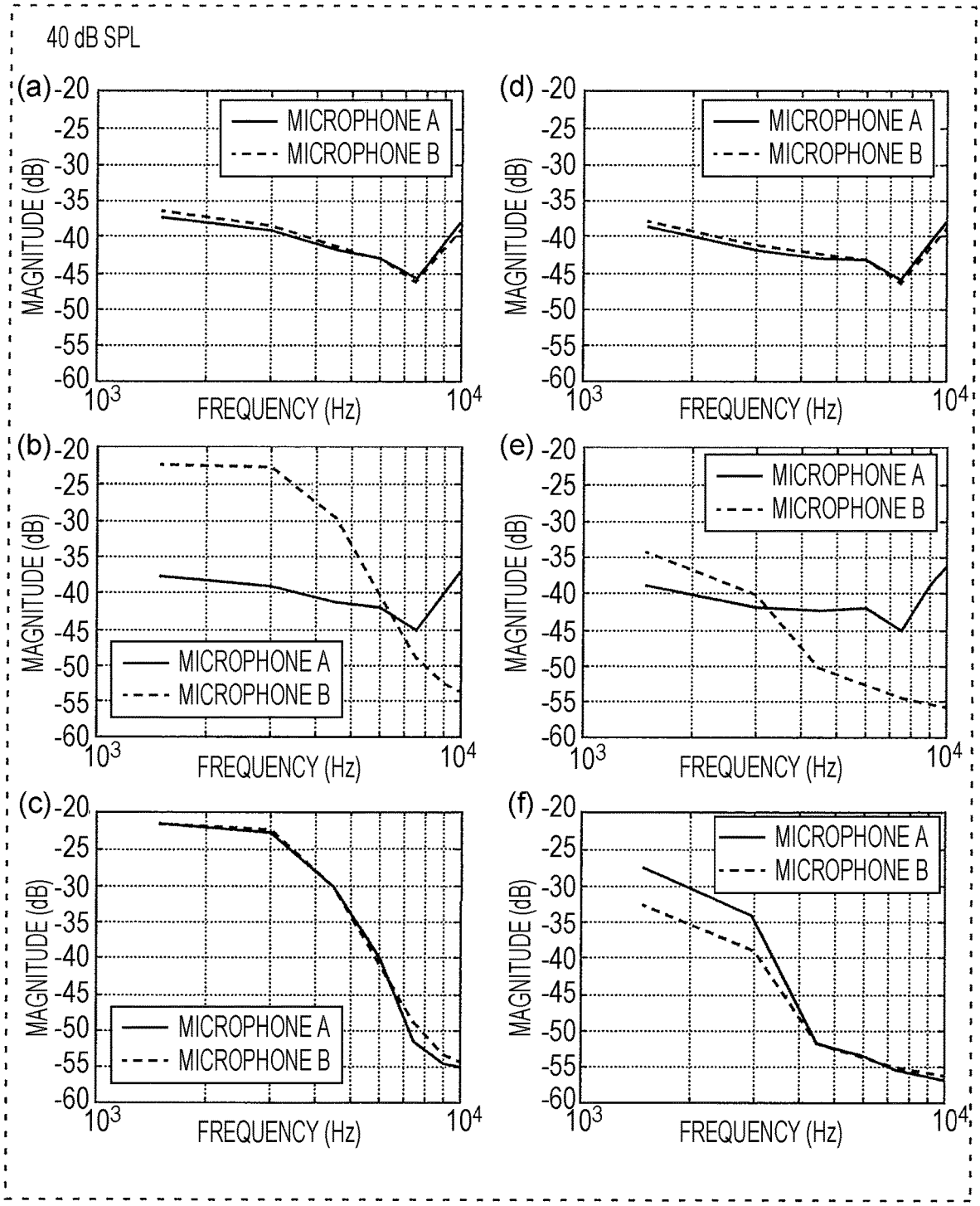
FIG. 6 illustrates graphs each of which indicates relationships at a magnified voice level of 40 dB SPL between frequency and signal level output by a signal level calculator.

FIG. 6 illustrates graphs each of which indicates relationships at a magnified voice level of 40 dB SPL between frequency and signal level output by the signal level calculator 130.

The graph in FIG. 6(*a*) indicates relationships between frequency and signal level output by the signal level calculator 130 in a case in which there was no noise source in the sound collecting apparatus 100 and in a state in which the sound holes 103 were not covered. The graph in FIG. 6(*b*) indicates relationships between frequency and signal level output by the signal level calculator 130 in a case in which there was no noise source in the sound collecting apparatus 100 and in a state in which one of the sound holes 103 was covered. The graph in FIG. 6(*c*) indicates relationships between frequency and signal level output by the signal level calculator 130 in a case in which there was no noise source in the sound collecting apparatus 100 and in a state in which both of the sound holes 103 were covered. The graph in FIG. 6(*d*) indicates relationships between frequency and signal level output by the signal level calculator 130 in a case in which there was a noise source in the sound collecting apparatus 100 and in a state in which the sound holes 103 were not covered. The graph in FIG. 6(*e*) indicates relationships between frequency and signal level output by the signal level calculator 130 in a case in which there was a noise source in the sound collecting apparatus 100 and in a state in which one of the sound holes 103 was covered. The graph in FIG. 6(*f*) indicates relationships between frequency and signal level output by the signal level calculator 130 in a case in which there was a noise source in the sound collecting apparatus 100 and in a state in which both of the sound holes 103 were covered.

Figure 7:
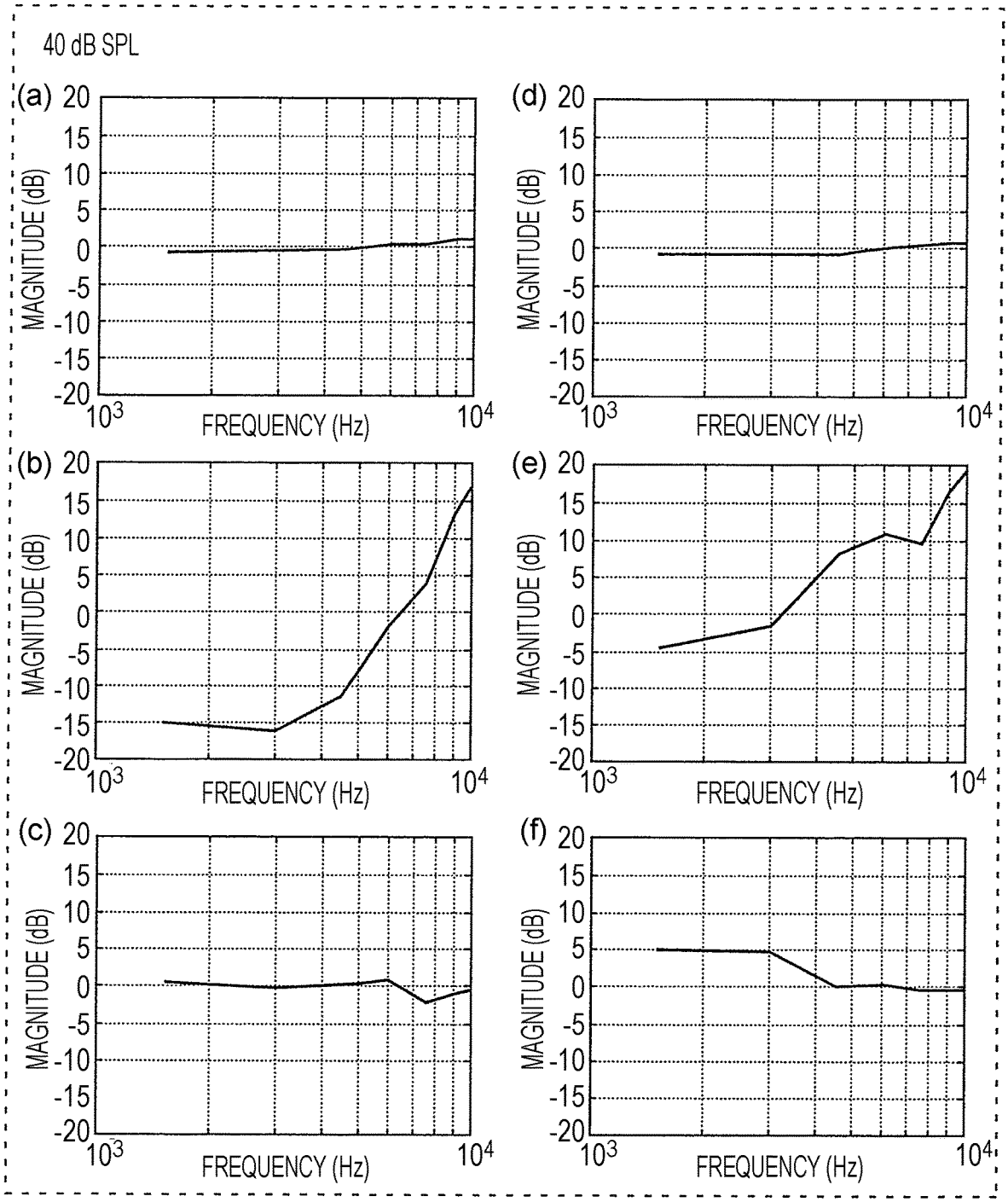
FIG. 7 illustrates graphs each of which indicates a relationship at a magnified voice level of 40 dB SPL between frequency and correlation values output by a correlation calculator.

FIG. 7 illustrates graphs each of which indicates a relationship at a magnified voice level of 40 dB SPL between frequency and correlation values (signal level magnitudes) output by the correlation calculator 140. In the graphs in FIGS. 7(*a*) to 7(*f*), the correlation values were calculated from ratios between the signal level of the microphone A and the signal level of the microphone B in FIGS. 6(*a*) to 6(*f*), according to equation (2).

The graph in FIG. 7(*a*) indicates a relationship between frequency and correlation values output by the correlation calculator 140 in a case in which there was no noise source in the sound collecting apparatus 100 and in a state in which the sound holes 103 were not covered. The graph in FIG. 7(*b*) indicates a relationship between frequency and correlation values output by the correlation calculator 140 in a case in which there was no noise source in the sound collecting apparatus 100 and in a state in which one of the sound holes 103 was covered. The graph in FIG. 7(*c*) indicates a relationship between frequency and correlation values output by the correlation calculator 140 in a case in which there was no noise source in the sound collecting apparatus 100 in the sound collecting apparatus 100 and in a state in which both of the sound holes 103 were covered. The graph in FIG. 7(*d*) indicates a relationship between frequency and correlation values output by the correlation calculator 140 in a case in which there was a noise source in the sound collecting apparatus 100 and in a state in which the sound holes 103 were not covered. The graph in FIG. 7(*e*) indicates a relationship between frequency and correlation values output by the correlation calculator 140 in a case in which there was a noise source in the sound collecting apparatus 100 and in a state in which one of the sound holes 103 was covered. The graph in FIG. 7(*f*) indicates a relationship between frequency and correlation values output by the correlation calculator 140 in a case in which there was a noise source in the sound collecting apparatus 100 and in a state in which both of the sound holes 103 were covered.

Figure 8:
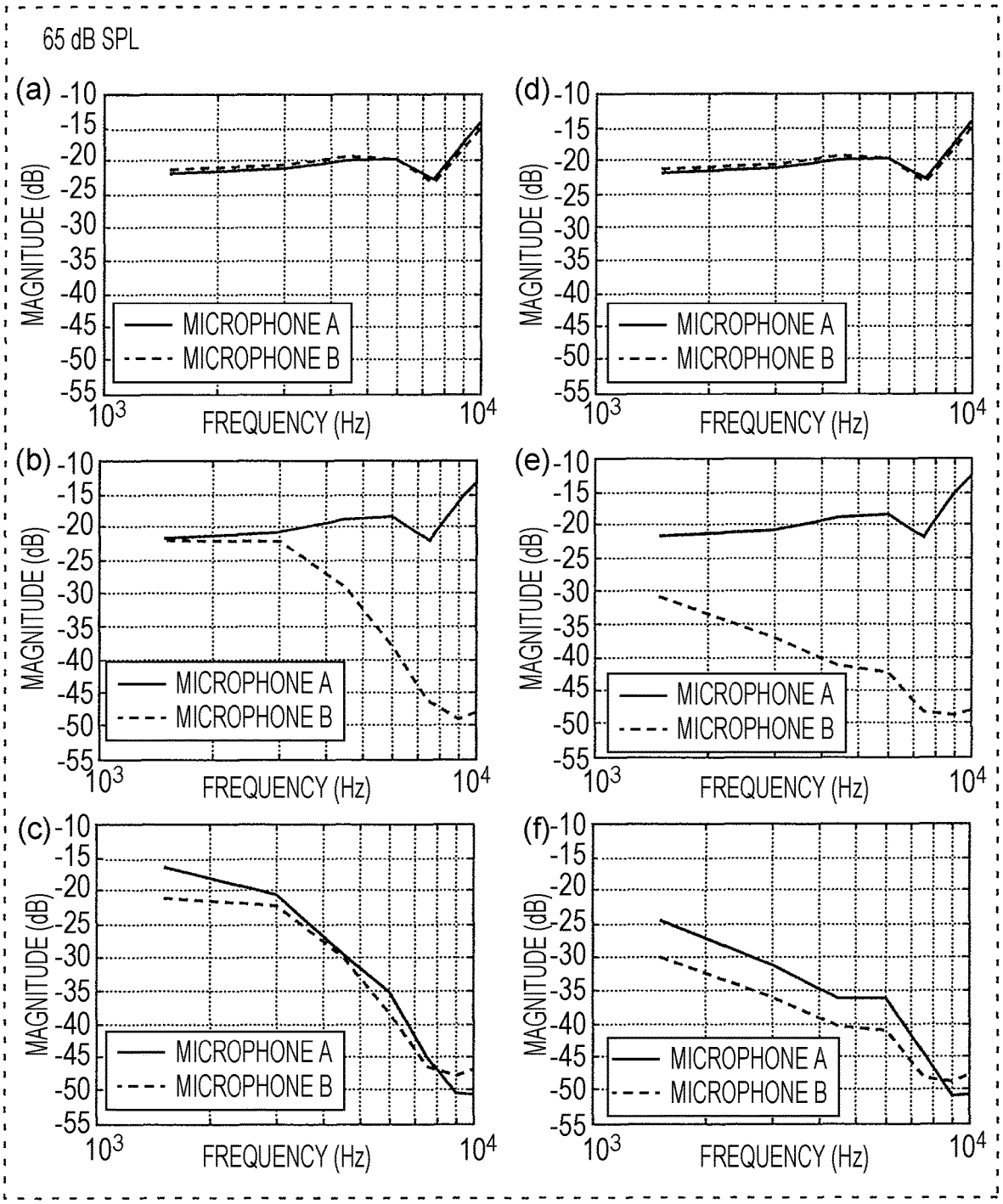
FIG. 8 illustrates graphs each of which indicates relationships at a magnified voice level of 65 dB SPL between frequency and signal level output by the signal level calculator.

FIG. 8 illustrates graphs each of which indicates relationships at a magnified voice level of 65 dB SPL between frequency and signal levels output by the signal level calculator 130.

The graph in FIG. 8(*a*) indicates relationships between frequency and signal level output by the signal level calculator 130 in a case in which there was no noise source in the sound collecting apparatus 100 and in a state in which the sound holes 103 were not covered. The graph in FIG. 8(*b*) indicates relationships between frequency and signal level output by the signal level calculator 130 in a case in which there was no noise source in the sound collecting apparatus 100 and in a state in which one of the sound holes 103 was covered. The graph in FIG. 8(*c*) indicates relationships between frequency and signal level output by the signal level calculator 130 in a case in which there was no noise source in the sound collecting apparatus 100 and in a state in which both of the sound holes 103 were covered. The graph in FIG. 8(*d*) indicates relationships between frequency and signal level output by the signal level calculator 130 in a case in which there was a noise source in the sound collecting apparatus 100 and in a state in which the sound holes 103 were not covered. The graph in FIG. 8(*e*) indicates relationships between frequency and signal level output by the signal level calculator 130 in a case in which there was a noise source in the sound collecting apparatus 100 and in a state in which one of the sound holes 103 was covered. The graph in FIG. 8(*f*) indicates relationships between frequency and signal level output by the signal level calculator 130 in a case in which there was a noise source in the sound collecting apparatus 100 and in a state in which both of the sound holes 103 were covered.

Figure 9:
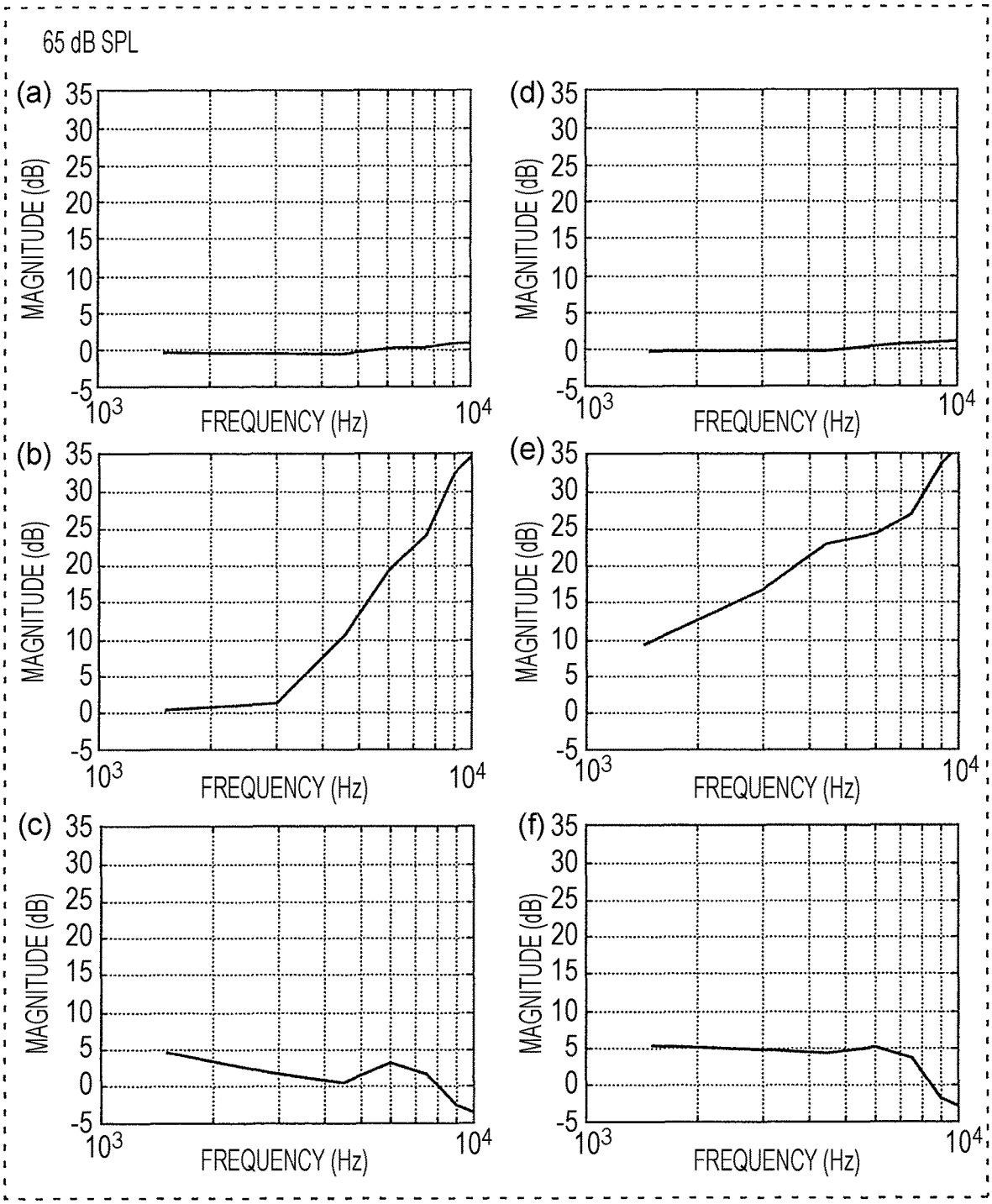
FIG. 9 illustrates graphs each of which indicates a relationship at a magnified voice level of 65 dB SPL between frequency and correlation values output by the correlation calculator.

FIG. 9 illustrates graphs each of which indicates a relationship at a magnified voice level of 65 dB SPL between frequency and correlation values output by the correlation calculator 140.

The graph in FIG. 9(*a*) indicates a relationship between frequency and correlation values output by the correlation calculator 140 in a case in which there was no noise source in the sound collecting apparatus 100 and in a state in which the sound holes 103 were not covered. The graph in FIG. 9(*b*) indicates a relationship between frequency and correlation values output by the correlation calculator 140 in a case in which there was no noise source in the sound collecting apparatus 100 and in a state in which one of the sound holes 103 was covered. The graph in FIG. 9(*c*) indicates a relationship between frequency and correlation values output by the correlation calculator 140 in a case in which there was no noise source in the sound collecting apparatus 100 and in a state in which both of the sound holes 103 were covered. The graph in FIG. 9(*d*) indicates a relationship between frequency and correlation values output by the correlation calculator 140 in a case in which there was a noise source in the sound collecting apparatus 100 and in a state in which the sound holes 103 were not covered. The graph in FIG. 9(*e*) indicates a relationship between frequency and correlation values output by the correlation calculator 140 in a case in which there was a noise source in the sound collecting apparatus 100 and in a state in which one of the sound holes 103 was covered. The graph in FIG. 9(*f*) indicates a relationship between frequency and correlation values output by the correlation calculator 140 in a case in which there was a noise source in the sound collecting apparatus 100 and in a state in which both of the sound holes 103 were covered.

In a state in which the sound holes 103 corresponding to the microphones A and B were not covered as in FIGS. 7(*a*) and 7(*d*) and FIGS. 9(*a*) and 9(*d*), it was found that the correlation value was within the range of 0 dB±3 dB at any frequency, indicating that there is no significant difference among correlation values.

However, in a state in which the sound hole 103 corresponding to the microphone B was covered as in FIGS. 7(*b*) and 7(*e*) and FIGS. 9(*b*) and 9(*e*), the correlation value was increased as frequency was increased. In FIGS. 7(*b*) and 7(*e*) and FIGS. 9(*b*) and 9(*e*), it was found that the correlation value largely varied depending on the frequency and was not near 0 dB at almost all frequencies unlike FIGS. 7(*a*) and 7(*d*) and FIGS. 9(*a*) and 9(*d*).

In a state in which both of the sound holes 103 were covered as in FIGS. 7(*c*) and 7(*f*) and FIGS. 9(*c*) and 9(*f*), it was confirmed that there were some frequency bands in which the correlation value was near 0 dB but these frequency bands were largely different from FIGS. 7(*a*) and 7(*d*) and FIGS. 9(*a*) and 9(*d*).

That is, at frequencies at which the magnitude of the signal level in FIGS. 7(*b*) and 7(*e*) and FIGS. 9(*b*) and 9(*e*) was near 0 dB, there was no difference in the magnitude of the signal level between FIGS. 7(*b*) and 7(*e*) and FIGS. 7(*a*) and 7(*c*) and between FIGS. 9(*b*) and 9(*e*) and FIGS. 9(*a*) and 9(*c*). At other frequencies, however, there were large differences in the magnitude of the signal level. Therefore, each microphone signal was divided into signals in different frequency bands so that changes in the frequency property can be analyzed.

From the above experimental results, the decider 150 may decide that when, for example, the correlation value is near 0 dB±3 dB in any frequency band, the sound holes 103 are not covered and that when the correlation value is outside the range of 0 dB±3 dB, at least one sound hole 103 is covered. In this case, the range from −3 dB to 3 dB is equivalent to the first threshold.

Effects

Next, effects of the sound collecting apparatus 100, the sound collection method, the recording medium recording a program that executes the sound collection method, and the imaging apparatus 1 using the sound collecting apparatus 100 in this embodiment will be described.

As described above, with the sound collecting apparatus 100 according to this embodiment, a plurality of microphones 110 collect external sounds and sounds from noise sources in the sound collecting apparatus 100, each microphone 110 outputting a microphone signal. The sound collecting apparatus 100 has: a plurality of band dividers 120 (dividers) corresponding to the plurality of microphones 110 on a one-to-one basis, each band divider 120 dividing a microphone signal into signals in mutually different frequency bands; a plurality of signal level calculators 130 corresponding to the plurality of band dividers 120 on a one-to-one basis, each signal level calculator 130 calculating a signal level for each frequency band; the correlation calculator 140 that calculates a correlation value between a plurality of microphones 110 for each identical frequency band according to signal levels; and the decider 150 that decides whether at least one of the plurality of microphones 110 is sound-insulated, according to a plurality of correlation values.

According to this, the band divider 120 divides a microphone signal into signals in a plurality of frequency bands, and the signal level calculator 130 calculates a signal level for each frequency band. In an example in which two signal level calculators 130 and the like are used as in this embodiment, according to signal levels calculated by one signal level calculator 130 and signal levels calculated by the other signal level calculator 130, the correlation calculator 140 calculates a correlation value between the two microphones 110 for each identical frequency band. Therefore, the decider 150 can decide whether at least one of the plurality of microphones 110 is sound-insulated, according to correlation values.

Therefore, whether at least one of the plurality of microphones 110 is sound-insulated can be correctly decided.

In the sound collection method in this embodiment, a plurality of microphones 110 collect external sounds and sounds from noise sources in the sound collecting apparatus 100, each microphone 110 outputting a microphone signal. In the sound collection method, a microphone signal is divided into signals in mutually different frequency bands. In the sound collection method, a signal level is calculated for each frequency band. In the sound collection method, a correlation value between a plurality of microphones 110 is calculated for each identical frequency band according to signal levels. In the sound collection method, whether at least one of the plurality of microphones 110 is sound-insulated, according to a plurality of correlation values.

In this sound collection method as well, effects similar to the effects of the sound collecting apparatus 100 are obtained.

The program recorded in the recording medium according to this embodiment causes a computer to execute the sound collection method.

With the recording medium as well that records the program that can execute the sound collection method in a computer, effects similar to the effects of the sound collecting apparatus 100 are obtained.

The imaging apparatus 1 according to this embodiment has the sound collecting apparatus 100, the displayer 7, and the controller 11 that receives, from the decider 150, information indicating that at least one microphone 110 is sound-insulated and causes the displayer 7 to display information indicating the sound insulation.

According to this, since the controller 11 receives, from the decider 150, information indicating that at least one microphone 110 is sound-insulated and causes the displayer 7 to display information indicating the sound insulation, the user can recognize that at least one microphone 110 is sound-insulated.

In the sound collecting apparatus 100 according to this embodiment, if at least one of correlation values in a plurality of frequency bands exceeds the first threshold, the decider 150 decides that the microphones 110 are sound-insulated.

According to this, if at least one correlation value exceeds the first threshold, the decider 150 decides that both microphones 110 are sound-insulated, it is possible to more accurately distinguish a difference between a case in which none of the microphones 110 are sound-insulated and a case in which all of the microphones 110 are sound-insulated.

In the sound collecting apparatus 100 according to this embodiment, the band divider 120 divides a signal into signals in frequency bands of 1 kHz or lower and signals in frequency bands higher than 1 kHz. If the decider 150 decides that correlation values only in frequency bands of 1 kHz or lower exceed the first threshold, the decider 150 decides that the microphones 110 are not sound-insulated.

According to this, the band divider 120 divides a signal with respect to a frequency of 1 kHz and, if the decider 150 decides that the first threshold is exceeded only in frequency bands of 1 kHz or lower, the decider 150 decides that the microphones 110 are not sound-insulated. Therefore, even if there are sounds attributable to a wind, vibration, and the like, it is possible to more accurately determine whether the microphones 110 are sound-insulated.

First Variation of the Embodiment

In this variation, an imaging apparatus 200 will be described with reference to FIG. 10.

Figure 10:
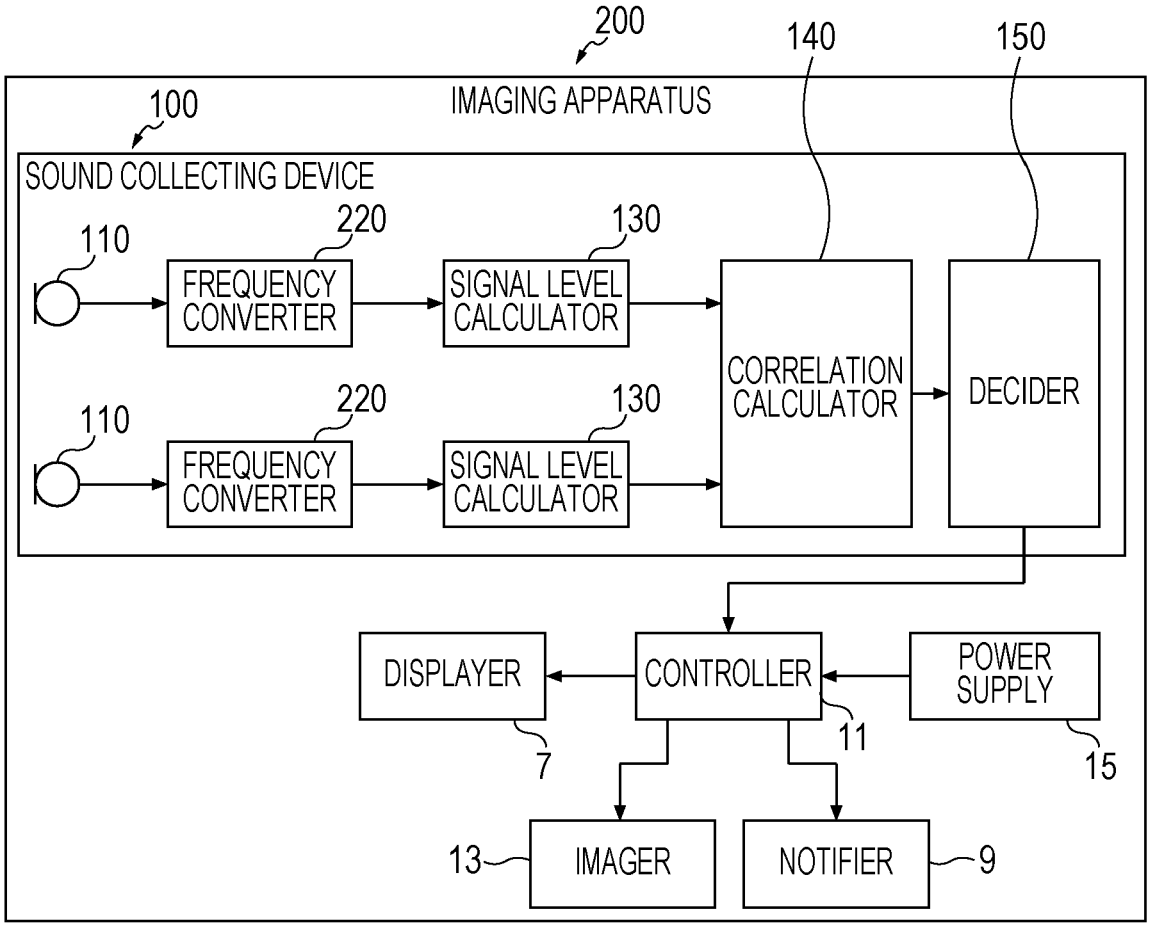
FIG. 10 is a block diagram indicating an imaging apparatus according to a first variation of the embodiment.

FIG. 10 is a block diagram indicating the imaging apparatus 200 according to the first variation of the embodiment.

This variation differs from the embodiment in that a frequency converter 220 is used instead of the band divider 120.

Other respects in this variation are the same as in the embodiment. Unless otherwise noted, therefore, like elements will be denoted by like reference numerals and detailed descriptions of the structures of these elements will be omitted.

As illustrated in FIG. 10, the frequency converter 220 (an example of a divider) is a device that converts a microphone signal from a time-domain signal to a frequency-domain signal on a per-frame basis (a frame is an example of a signal). For example, the frequency converter 220 performs frequency conversion on a microphone signal by using a frequency conversion method such as a Fourier transform to obtain a frequency signal. Specifically, the frequency converter 220 receives a microphone signal from the microphone 110, divides the microphone signal into frames, each of which has a predetermined time length, and performs a fast Fourier transform (FFT) for each frame to create a signal spectrum, obtaining a complex spectrum from the signal spectrum. The complex spectrum is a frequency-specific voice spectrum.

If the frequency domain obtained after frequency conversion by the frequency converter 220 is a complex spectrum, a signal level P(ω) is calculated according to equation (3), in which x(ω, k) (ω is a frequency and k is a frame number) is an observation signal at a frequency and M is the number of frames.

$$P(\omega) = \frac{1}{M}\sum_{k=0}^{M-1} |x(\omega, k)| \tag{3}$$

Equation (3) may be obtained from the mean-square value of the observation signals x(ω, k) instead of an absolute value. In calculation of an average, a method of calculating an exponential moving average or another type of average may be used instead of a method of calculating a moving average. When an exponential moving average is used, the amount of computation can be reduced and the amount of memory usage can thereby be reduced.

Second Variation of the Embodiment

In this variation, the correlation calculator 140 in the sound collecting apparatus 100 will be described.

This variation differs from the embodiment in that the correlation calculator 140 further calculates a variance value from correlation values for each frequency band.

Other respects in this variation are the same as in the embodiment. Unless otherwise noted, therefore, like elements will be denoted by like reference numerals and detailed descriptions of the structures of these elements will be omitted.

The correlation calculator 140 calculates a ratio of between a signal level calculated by one signal level calculator 130 and a signal level calculated by the other signal level calculator 130 (the ratio is an example of a correlation value) according to equation (2).

As illustrated in FIG. 2, the correlation calculator 140 calculates a variance value S(x) from a correlation value calculated by the correlation calculator 140 for each frequency band. Assuming that a correlation value is x and the number of correlation values is L, the variance value S(x) is calculated according to equation (4).

$$S(x) = \frac{1}{L}\sum_{i=0}^{i=L-1} (x_i - \bar{x})^2 \tag{4}$$

In this variation, a frequency band is divided into eight segments, the number L of correlation values is 8.

If at least one of the variance values calculated from a plurality of correlation values exceeds a second threshold, the decider 150 decides that the microphones 110 are sound-insulated. The second threshold may be determined by calculating a variance value from equation (4) according to results in FIGS. 7 and 9 referenced in the embodiment.

Effects

Next, effects of the sound collecting apparatus 100, the sound collection method, the recording medium recording a program that executes the sound collection method, and the imaging apparatus 1 using the sound collecting apparatus 100 in this variation will be described.

As described above, with the sound collecting apparatus 100 according to this variation, the correlation calculator 140 calculates a variance value from a plurality of correlation values for each frequency band. If at least one of the calculated correlation values exceeds the second threshold, the decider 150 decides that the microphones 110 are sound-insulated.

According to this, since the correlation calculator 140 calculates a variance value from a plurality of correlation values for each frequency band and, if at least one of the calculated correlation values exceeds the second threshold, the decider 150 decides that the microphones 110 are sound-insulated, it is possible to more accurately determine whether the microphones 110 are sound-insulated.

Effects in this variation are similar to the effects in the embodiment, so details of identical effects will be omitted.

Other Variations

So far, the present disclosure has been described according to the embodiment and its variations. However, the present disclosure is not limited to the above embodiment and variations. The present disclosure also includes cases described below.

For example, in the second variation of the above embodiment, a difference may be calculated between the signal level calculated by one signal level calculator and the signal level calculated by another signal level calculator. Specifically, a difference between the microphones A and B illustrated in FIGS. 6 and 8 may be calculated. In this case, the calculated difference may be normalized. A predetermined threshold may be set according to the normalized value. If the predetermined threshold is exceeded, a decider may decide whether the sound holes are covered.

In the above embodiment, the decider 150 has decided whether sound collection by the microphones 110 is impeded. However, a decider may just decide whether at least one of the correlation values calculated for each frequency band exceeds the first threshold, and a controller may obtain, from a decider, a signal indicating that a correlation value exceeds the first threshold, after which the controller may decide whether sound collection by the microphones 110 is impeded.

In the above embodiment, if the sound collecting apparatus 100 has, for example, three microphones, three band dividers, and three signal level calculators, signal levels calculated by a first signal level calculator, signal levels calculated by a second signal level calculator, and signal levels calculated by a third signal level calculator are entered into a correlation calculator. Then, the correlation calculator calculates a correlation value between two microphones for each identical frequency band from the signal levels calculated by the first signal level calculator and the signal levels calculated by the second signal level calculator. The correlation calculator also calculates a correlation value between two microphones for each identical frequency band from the signal levels calculated by the first signal level calculator and the signal levels calculated by the third signal level calculator. Thus, even if the sound collecting apparatus 100 has three or more microphones, the correlation calculator calculates correlation values among a plurality of microphones. Here, the correlation calculator may calculate a correlation value between two microphones for each identical frequency band from the signal levels calculated by the second signal level calculator and the signal levels calculated by the third signal level calculator.

In the above embodiment, if there is no correlation among correlation values in all frequency bands as in, for example, FIG. 7(*e*), the decider 150 may decide that the sound holes are covered.

Without being limited to an imaging apparatus (such as a DSC), the present disclosure can also be applied to a vehicle. When the present disclosure is applied to a vehicle, its body functions as a sound collecting apparatus. Load noise outside the vehicle body and an engine sound from the engine room enter the interior of the vehicle. When entering the interior of the vehicle, the load noise or engine sound transmits through the vehicle body, in which a microphone, electrical components, and the like are accommodated. Therefore, this load noise or sound is equivalent to a noise source in the housing. If sounds are reproduced from a speaker mounted in the vehicle, a reproduced sound leaks into the vehicle body. Therefore, this sound is also equivalent to a noise source in the housing. Thus, in a case as well in which the present disclosure is applied to a vehicle, if the sound holes are covered, a similar phenomenon occurs.

In the above embodiment, each apparatus is a computer system including a microprocessor, a read-only memory (ROM), a random-access memory (RAM), a hard disk unit, a display unit, a keyboard, a mouse, and the like. A computer program is stored in the RAM or hard disk unit in advance. When the microprocessor operates as commanded by the computer program, each apparatus achieves its functions. The computer program is a combination of a plurality of instruction codes that issue commands to the computer to achieve prescribed functions.

In the above embodiment, part or all of the constituent elements of each apparatus may be formed in the form of a single system large-scale integration (LSI) circuit. A system LSI circuit is a super multi-function LSI circuit manufactured by combining a plurality of constituent elements on a single chip. Specifically, a system LSI is a computer system that includes a microprocessor, a ROM, a RAM, and other components. A computer program is stored in the RAM. When the microprocessor operates as commanded by the computer program, the system LSI circuit achieves its functions.

In the above embodiment, par or all of the constituent elements of each apparatus described above may be formed in the form of an IC card or standalone module attachable to and detachable from each apparatus. The IC card or standalone module is a computer system that includes a microprocessor, a ROM, a RAM, and other components. The IC card or standalone module may include the super LSI circuit described above. When the microprocessor operates as commanded by a computer program, the IC card or standalone module achieves its functions. The IC card or standalone module may be tamper resistant.

In the above embodiment, the present disclosure may be the method described above. Alternatively, the present disclosure may be a computer program that causes a computer to implement the method or may be digital signals in the form of the computer program described above.

In the above embodiment, the present disclosure may be a computer-readable recording medium, such as, for example, a flexible disk, a hard disk, a compact disc-read-only memory (CD-ROM), a magneto-optical (MO) disk, a digital versatile disc (DVD), a DVD-ROM, a DVD-RAM, a Blu-ray (registered trademark) disc (BD), a semiconductor memory, or the like, on which the computer program or digital signals are recorded. Alternatively, the present disclosure may be the digital signals recorded in the recording medium described above.

In the above embodiment, the present disclosure may transmit the computer program or digital signals through a telecommunication line, wireless communication, a wired communication line, a network typified by the Internet, data broadcasting, or the like.

In the above embodiment, the present disclosure may be a computer system including a microprocessor and a memory. The memory may have stored the computer program. The microprocessor may operate as commanded by the computer program.

In the above embodiment, the present disclosure may be practiced by another independent computer system to which the program or digital signals recorded on the recording medium are transferred or to which the program or digital signals are transferred through the network or the like.

In addition, the present disclosure includes embodiments obtained by applying various variations that a person having ordinary skill in the art thinks of to the embodiment described above and its variations, and also includes embodiments implemented by combining arbitrary constituent elements and functions in the embodiment described above and its variations without departing from the intended scope of the present disclosure.

The sound collecting apparatus, the sound collection method, the recording medium recording a program, and the imaging apparatus are used in mobile terminal apparatuses, imaging apparatuses, recording apparatuses, and the like.

What is claimed is:

1. A sound collecting apparatus, comprising:

a plurality of microphones that collects a first sound from outside the sound collecting apparatus and a second sound from a noise source in the sound collecting apparatus, each of the plurality of microphones outputting a microphone signal, the noise source in the sound collecting apparatus being attributable to at least one of an image stabilization mechanism or a heat fan; and at least one processor that, in operation, performs operations including:

dividing, on a one-to-one basis with the plurality of microphones, the microphone signal output by each of the plurality of microphones into signals in mutually different frequency bands;

calculating, on a one-to-one basis with the dividing of the microphone signal output by each of the plurality of microphones, a signal level for each of the mutually different frequency bands;

calculating correlation values between the plurality of microphones for each group of identical frequency bands according to the signal level calculated for each of the mutually different frequency bands; and deciding whether at least one of the plurality of microphones is sound-insulated, according to the correlation values, wherein, in the dividing, the microphone signal output by each of the plurality of microphones, which is divided into the signals in the mutually different frequency bands, includes the first sound from outside the sound collecting apparatus and the second sound from the noise source in the sound collecting apparatus, and in the deciding, when at least one of the correlation values exceeds a threshold value, the at least one of the plurality of microphones is decided to be sound-insulated.

2. The sound collecting apparatus according to claim 1, wherein the microphone signal is divided into signals in frequency bands of 1 kHz or lower and signals in frequency bands higher than 1 kHz, and when the correlation values exceed the threshold value only in the frequency bands of 1 kHz or lower, the plurality of microphones is decided to be not sound-insulated.

3. The sound collecting apparatus according to claim 1, wherein the operations further include:

calculating variance values from the correlation values for each frequency band, and when at least one of the variance values exceeds a second threshold value, the plurality of microphones is decided to be sound-insulated.

4. The sound collecting apparatus according to claim 1, wherein the microphone signal is divided into signals in predetermined frequency bands, and when only one of the correlation values in a predetermined one of the predetermined frequency bands exceeds the threshold value, the plurality of microphones is decided to be not sound-insulated.

5. The sound collecting apparatus according to claim 4, wherein when one of the correlation values in one of the predetermined frequency bands different than the predetermined one of the predetermined frequency bands exceeds the threshold value, the plurality of microphones s decided to be sound-insulated.

6. The sound collecting apparatus according to claim 5, wherein the predetermined one of the predetermined frequency bands includes frequency bands of 1 kHz or lower.

7. The sound collecting apparatus according to claim 1, wherein the microphone signal is divided into signals in predetermined frequency bands, and when one of the correlation values in any of the predetermined frequency bands exceeds the threshold value, the plurality of microphones is decided to be sound-insulated.

8. The sound collecting apparatus according to claim 1, wherein the microphone signal is divided into signals in predetermined frequency bands, and when the correlation values in all of the predetermined frequency bands are at most equal to the threshold value, the plurality of microphones is decided to be not sound-insulated.

9. The sound collecting apparatus according to claim 1, wherein each of the plurality of microphones has a same structure.

10. The sound collecting apparatus according to claim 9, wherein different processors perform the operations for the microphone signal of each of the plurality of microphones, and the different processors have a same structure.

11. The sound collecting apparatus according to claim 1, wherein the correlation values between the plurality of microphones include a ratio of the signal level calculated for one of the mutually different frequency bands for one of the plurality of microphones to the signal level calculated for the one of the mutually different frequency bands for another of the plurality of microphones.

12. The sound collecting apparatus according to claim 1, wherein the sound collecting apparatus is a camera that includes the plurality of microphones.

13. The sound collecting apparatus according to claim 12, further comprising:

a display, wherein, when the plurality of microphones is decided to be sound-insulated, the display displays an alert indicating that the plurality of microphones is sound-insulated.

14. The sound collecting apparatus according to claim 1, wherein the first sound from outside the sound collecting apparatus and the second sound from the noise source in the sound collecting apparatus are divided, on the one-to-one basis with the plurality of microphones, into the signals in the mutually different frequency bands.

15. The sound collecting apparatus according to claim 1, wherein each of the plurality of microphones includes a vibration plate for collecting the second sound from the noise source in the sound collecting apparatus.

16. A sound collection method for a sound collecting apparatus, the sound collecting apparatus including a plurality of microphones, the sound collection method comprising:

collecting a first sound from outside the sound collecting apparatus and a second sound from a noise source in the sound collecting apparatus by use of the plurality of microphones, and outputting a plurality of microphone signals;

dividing each of the plurality of microphone signals into signals in mutually different frequency bands;

calculating, for each of the plurality of microphone signals, a signal level for each of the mutually different frequency bands;

calculating correlation values between the plurality of microphones for each group of identical frequency bands according to the signal level calculated for each of the mutually different frequency bands and for each of the plurality of microphone signals; and deciding whether at least one of the plurality of microphones is sound-insulated, according to the correlation values, wherein the noise source in the sound collecting apparatus is attributable to at least one of an image stabilization mechanism or a heat fan, in the dividing, each of the plurality of microphone signals, which is divided into the signals in the mutually different frequency bands, includes the first sound from outside the sound collecting apparatus and the second sound from the noise source in the sound collecting apparatus, and in the deciding, when at least one of the correlation values exceeds a threshold value, the at least one of the plurality of microphones is decided to be sound-insulated.

17. A non-transitory computer-readable recording medium including a program that causes a computer to execute a sound collection method for a sound collecting apparatus, the sound collecting apparatus including a plurality of microphones, the program, when executed in the computer, causing the computer to execute operations including:

collecting a first sound from outside the sound collecting apparatus and a second sound from a noise source in the sound collecting apparatus by use of the plurality of microphones, and outputting a plurality of microphone signals;

dividing each of the plurality of microphone signals into signals in mutually different frequency bands;

calculating, for each of the plurality of microphone signals, a signal level for each of the mutually different frequency bands;

calculating correlation values between the plurality of microphones for each group of identical frequency bands according to the signal level calculated for each of the mutually different frequency bands and for each of the plurality of microphone signals; and deciding whether at least one of the plurality of microphones is sound-insulated, according to the correlation values, wherein the noise source in the sound collecting apparatus is attributable to at least one of an image stabilization mechanism or a heat fan, in the dividing, each of the plurality of microphone signals, which is divided into the signals in the mutually different frequency bands, includes the first sound from outside the sound collecting apparatus and the second sound from the noise source in the sound collecting apparatus, and in the deciding, when at least one of the correlation values exceeds a threshold value, the at least one of the plurality of microphones is decided to be sound-insulated.

18. An imaging apparatus, comprising:

a sound collecting apparatus, a display; and a controller; wherein the sound collecting apparatus includes:

a plurality of microphones that collects a first sound from outside the sound collecting apparatus and a second sound from a noise source in the sound collecting apparatus, each of the plurality of microphones outputting a microphone signal, the noise source in the sound collecting apparatus being attributable to at least one of an image stabilization mechanism or a heat fan, the sound collecting apparatus performs operations including:

dividing, on a one-to-one basis with the plurality of microphones, the microphone signal output by each of the plurality of microphones into signals in mutually different frequency bands;

calculating on a one-to-one basis with the dividing of the microphone signal output by each of the plurality of microphones, a signal level for each of the mutually different frequency bands;

calculating correlation values between the plurality of microphones for each group of identical frequency bands according to the signal level calculated for each of the mutually different frequency bands; and deciding whether at least one of the plurality of microphones is sound-insulated, according to the correlation values, and the controller receives, from the sound collecting apparatus and when the at least one of the plurality of microphones is decided to be sound-insulated, information indicating that at least one microphone is sound-insulated and causes the display to display information indicating sound insulation, wherein, in the dividing, the microphone signal output by each of the plurality of microphones, which is divided into the signals in the mutually different frequency bands, includes the first sound from outside the sound collecting apparatus and the second sound from the noise source in the sound collecting apparatus, and in the deciding, when at least one of the correlation values exceeds a threshold value, the at least one of the plurality of microphones is decided to be sound-insulated.

* * * * *